US005976343A

United States Patent [19]

Schlaak

[11] Patent Number: 5,976,343

[45] Date of Patent: Nov. 2, 1999

[54] MULTI-COAT PAINTING PROCESS

[75] Inventor: Detlef Schlaak, Wuppertal, Germany

[73] Assignee: Herberts Gesellschaft mit beschrankter Haftung, Wuppertal, Germany

[21] Appl. No.: 09/101,271

[22] PCT Filed: Feb. 19, 1997

[86] PCT No.: PCT/EP97/00784

§ 371 Date: Dec. 10, 1998

§ 102(e) Date: Dec. 10, 1998

[87] PCT Pub. No.: WO97/30795

PCT Pub. Date: Aug. 28, 1997

[30] Foreign Application Priority Data

Feb. 23, 1996 [DE] Germany ..... 196 06 716

[51] Int. Cl.[6] ..... C23C 28/00

[52] U.S. Cl. ..... 205/198; 205/149; 205/158; 427/388.4; 427/393.5; 427/409

[58] Field of Search ..... 427/388.4, 393.5, 427/409; 205/149, 158, 198

[56] References Cited

FOREIGN PATENT DOCUMENTS

| | | |
|---|---|---|
| 238 037 | 9/1987 | European Pat. Off. . |
| 265 363 | 4/1988 | European Pat. Off. . |
| 548 845 | 6/1993 | European Pat. Off. . |
| 36 28 124 | 3/1988 | Germany . |
| 40 00 889 | 7/1991 | Germany . |
| 42 24 617 | 1/1994 | Germany . |
| 195 41 461 | 5/1996 | Germany . |
| 95/28429 | 10/1995 | WIPO . |

OTHER PUBLICATIONS

Ladstadter, E., "Principles of the 'SPLITT' stone chip apparatus. Use in automobile paint systems testing." Farbe Lack 1984, vol. 90 No. 8, pp. 646–653.

*Primary Examiner*—Christopher Raimund
*Attorney, Agent, or Firm*—Pillsbury Madison & Sutro LLP

[57] ABSTRACT

Process for multi-coat lacquering of a substrate with a stoved first electrodeposition layer by applying a second surface coating layer of 10 to 30 μm dry layer thickness consisting of a base lacquering agent containing a first, water-based, polyurethane resin, and wet-on-wet application of a third coating agent with a thinner dry layer thickness of 7 to 15 μm consisting of a second water-based base lacquering agent, further application without prior stoving of a clear lacquer layer and mutual stoving, wherein the first base lacquering agent has a higher concentration of polyurethane resin than the second base lacquering agent.

9 Claims, No Drawings

MULTI-COAT PAINTING PROCESS

FIELD OF THE INVENTION

The invention relates to a process for producing a multi-layered lacquering, in particular on metallic substrates, which is particularly suitable for vehicle lacquerings.

BACKGROUND OF THE INVENTION

Modern production line car lacquerings mostly consist of a base lacquer/clear lacquer top coat which is applied to an electrophoretically primed car body which has been provided with a filler layer. The base lacquer and clear lacquer are preferably applied wet-on-wet, i.e. the clear lacquer is applied to the base lacquer after an evaporation time, optionally with heating, and the two are stoved together after the clear lacquer has been applied. EP-A-0 238 037 discloses a process which can be used to reduce the stoved layers in which a filler and a water-based metallic base lacquer are applied by the wet-on-wet process. The examples section reveals that the filler layer is applied with a dry film thickness of 35 $\mu$m which is conventional for filler lacquers.

EP-A-0 265 363 discloses providing a previously stoved cataphoretically applied primer with a two-layered base lacquer/clear lacquer top coat using a wet-on-wet process. There is no filler layer. However, there is a problem in that damage due to flying stones on vehicles lacquered by this process is particularly conspicuous since the primer layer is revealed when the impact of a stone dislodges the top coat. Although corrosion protection is still guaranteed, the visual impression cannot be tolerated.

For reasons of rationalisation and in order to save materials, there is a desire to reduce the thickness of the layers in vehicle lacquerings when building up the lacquer, but without producing any substantial losses in overall characteristics.

SUMMARY OF THE INVENTION

The object of the invention is to provide a process for producing multi-coat lacquerings, in particular vehicle lacquerings, with a thinner overall layer structure for the total lacquer application, but with comparable overall properties as compared with the prior art, and which can be performed with the smallest possible number of stoving steps.

Surprisingly, the object is achieved by the process provided by the invention for multi-coat lacquering of a substrate provided with a stoved first electrodeposition lacquer layer, which is characterised in that a second coating layer corresponding to a dry layer thickness of 10 to less than 30 $\mu$m consisting of a first water-based, colour and/or effect-providing base lacquering agent which contains one or more polyurethane resins is applied to the first electrodeposition lacquer layer, wherein a third coating layer corresponding to a dry layer thickness of 7 to 15 $\mu$m consisting of a second water-based, colour and/or effect-providing base lacquering agent is applied wet-on-wet and a fourth coating layer consisting of a clear lacquer coating agent is applied to the third coating layer without prior stoving and the second, third and fourth coating layers are stoved together, wherein a first water-based base lacquering agent is used which has a higher concentration of polyurethane resin than the second base lacquering agent, with respect to the total weight of the particular water-based base lacquering agent, and wherein the solids content in the first base lacquering agent differs by not more than 20% from the absolute value of the weight of solid resin in the second base lacquering agent.

As a result of the process according to the invention, it is possible to apply a water-based base lacquering agent directly onto a stoved first coating layer built up by electrodeposition and to fire this layer together with the subsequently-applied second water-based base lacquer layer and clear lacquer layer, wherein conventional filler layers or other intermediate layers are not required.

DETAILED DESCRIPTION OF THE INVENTION

Any anodic or cathodic depositable electrodeposition lacquers (EDL) known per se which are not subject to any restrictions, may be used as electrodeposition coating agents for producing the first coating layer, that is a primer coat.

These are, for example, water-based coating agents with a solids content up to 50 wt. %, for example 10 to 20 wt. %. The solids are formed from conventional binders for electrodeposition coatings which contain ionic groups or groups which can be converted into ionic groups and optionally groups which are able to participate in chemical cross-linking, and optionally present cross-linking agents, pigments, fillers and/or conventional additives for lacquers. The ionic groups or groups which can be converted into ionic groups may be anionic groups or groups which can be converted into anionic groups, e.g. acid groups such as COOH groups or cationic groups or groups which can be converted into cationic groups, e.g. basic groups such as amino, ammonium, e.g. quaternary ammonium, groups, phosphonium and/or sulfonium groups. Binders with basic groups are preferred. Nitrogen-containing basic groups are particularly preferred. These groups may be present as quaternary compounds or may be at least partly converted into ionic groups by using a conventional neutralising agent, an acid, e.g. an organic monocarboxylic acid such as e.g. formic acid or acetic acid.

To produce the first coating layer, the electrodeposition lacquer layer, conventional anodically depositable electrodeposition lacquer binders and lacquers (ADL) which contain anionic groups may be used. These are, for example, binders based on polyesters, epoxide resins, poly(meth) acrylates, maleinate oils or polybutadiene oils with a weight average molecular weight of for example 300 to 10,000 and an acid value of 35 to 300 mg KOH/g. The binder contains e.g. COOH, $SO_3H$ and/or $PO_3H_2$ groups. The resins may be converted into a water-based phase after neutralisation of at least some of the acid groups. The binders may be self cross-linking or may require the addition of a cross-linking agent. The lacquers may then also contain conventional cross-linking agents, e.g. triazine resins, cross-linking agents which contain transesterifiable groups or blocked polyisocyanates. Specific examples of anodically depositable electrodeposition binders and lacquers (ADL) which contain anionic groups and can be used in the process according to the invention are described e.g. in DE-A-28 24 418.

Preferably, however, cathodically depositable electrodeposition lacquers (CDL) based on cationic or basic binders are used for producing the first coating layer. These primer resins are, for example, resins which contain primary, secondary or tertiary amino groups in which the amine value is e.g. 20 to 250 mg KOH/g. The weight average of the molecular weight (Mw) of the primer resin is preferably 300 to 10,000. Examples of these primer resins are amino(meth) acrylate resins, aminoepoxide resins, aminoepoxide resins with terminal double bonds, aminoepoxide resins with primary OH groups, aminopolyurethane resins, amino group-containing polybutadiene resins or modified epoxide resin/carbon dioxide/amine reaction products. These primer resins may be self cross-linking or may be used mixed with known cross-linking agents. Examples of these cross-linking agents are aminoplast resins, blocked polyisocyanates, cross-linking agents with terminal double bonds, polyepoxide compounds or cross-linking agents which contain a trans-esterifiable group. Specific examples of primer resins and cross-linking agents which can be used in cathodic deposition lacquers (CDL) baths are described e.g. in EP-A-0 082 291, EP-A-0 234 395, EP-A-0 227 975, EP-A-0 178 531, EP-A-0 333 327, EP-A-0 310 971, EP-A-0 456 270, U.S. Pat. No. 3 922 253, EP-A-0 261 385, EP-A-0 245 786, DE-A-33 24 211, EP-A-0 414 199, EP-A-0 476 514.

These resins may be used separately or in a mixture. So-called "non-yellowing" CDL systems which avoid yellowing or discoloration of multi-coat lacquerings during stoving are preferably used. These may be, for example, CDL systems which cross-link by means of specifically selected blocked polyisocyanates such as are described, for example, in EP-A-0 265 363.

In addition to the primer resins and optionally present cross-linking agents, the electrodeposition lacquer (EDL) coating agents may also contain pigments, fillers and/or additives conventionally used in lacquers. The pigments and fillers may be conventional inorganic and/or organic pigments and fillers. Examples are carbon black, titanium dioxide, iron oxide pigments, phthalocyanine pigments, quinacridone pigments, kaolin, talcum or silicon dioxide.

The pigments may be dispersed to produce pigment pastes, e.g. by using known paste resins. These resins are familiar to a person skilled in the art. Examples of paste resins which can be used in CDL baths are described in EP-A-0 183 025 and in EP-A-0 469 497.

Conventional additives such as are known for example for EDL coatings may be used as additives. Examples of these are wetting agents, neutralising agents, flow control agents, catalysts, corrosion inhibitors, antifoam agents, solvents, but in particular light stabilisers optionally combined with antioxidants.

Conventional water-based colour and/or effect-providing base lacquers which are familiar to a person skilled in the art and are used to produce base lacquer/clear lacquer intermediate coatings are used to produce the second and third coating layers in the process according to the invention. These are described in large numbers in the patent literature.

The water-based base lacquers may be physically drying or may be cross-linkable with the production of covalent bonds. Water-based base lacquers which cross-link with the formation of covalent bonds may be self cross-linking systems or require the addition of a cross-linking agent. They may be single or two component systems; single component systems are preferred.

The water-based base lacquers which can be used in the process according to the invention contain water-dilutable binders. These contain non-ionic and/or ionic groups which provide the hydrophilicity which guarantees their water dilutability.

Examples of appropriate non-ionically stabilised binders are binders in which the water dilutability is achieved by incorporating polyether segments into the resin molecule. Specific examples of these types of stabilised polyurethane or polyurethane/acrylate resins are described e.g. in EP-A-0 354 261, EP-A-0 422 357 and EP-A-0 424 705.

Water-dilutable binders which contain ionic groups may be binders which contain cationic or anionic groups.

Examples of cationically stabilised binders which may be used according to the invention are completely or partly neutralised cationic (meth)acrylic copolymer, polyester, polyurethane and/or polyurethane/urea resins, in particular with a number average molecular weight (Mn) of 500 to 500,000, an OH value of 0 to 450, an amine value of 20 to 200 and a glass transition temperature of −50 to +150° C. Specific examples of these binders which are familiar to a person skilled in the art are described in DE-A-40 11 633.

The water-based base lacquers preferably contain binders which are stabilised by anionic groups. These are one or more film-forming resins such as are conventionally used in water-based coating agents, in particular in water-based base lacquers. The film-forming resin may be, for example, polyester, (meth)acrylic copolymers or preferably polyurethane resins. They may be self cross-linking or require the addition of a cross-linking agent or physically drying. Specific examples of suitable water-dilutable (meth)acrylic copolymers are described e.g. in EP-A-0 399 427 and EP-A-0 287 144.

Specific examples of suitable water-dilutable polyester resins are described e.g. in DE-A-29 26 854, DE-A-38 32 142 and EP-A-0 301 300.

It is also possible to use mixtures of binders. Particularly suitable binders are those in which (meth)acrylic copolymer and polycondensation resin are linked covalently or are present in the form of interpenetrating resin molecules. Examples of this type of combination are (meth)acrylic copolymer and polyester resin. Specific examples of a combination which can be used in this way are described for example in EP-A-0 226 171.

Anionically stabilised polyurethane resins are particularly preferably used. These polyurethane resins are familiar to a person skilled in the art and large numbers are described in the literature. These are water-based polyurethane dispersions or solutions or those binders in which (meth)acrylic copolymer and polyurethane resin are linked covalently or are present in the form of interpenetrating resin molecules. Examples of suitable polyurethane dispersions are stable, water-based dispersions with a solids content of 20 to 50 wt. %. The weight average molecular weight (Mw) of the resins may vary between wide limits, e.g. from 1000 to 500,000. The polyurethane resins may contain functional groups such as e.g. hydroxyl groups or blocked isocyanate groups.

Specific examples of polyurethane dispersions which may be used are those which can be prepared by chain lengthening of isocyanate functional prepolymers with polyamine and/or polyol. They are described for example in EP-A-0 089 497, EP-A-0 228 003, DE-A-36 28 124 and EP-A-0 512 524.

Further examples are polyurethane dispersions which can be prepared by chain lengthening of isocyanate functional prepolymers with water, such as are described e.g. in DE-A-39 15 459 and DE-A-42 24 617.

Polyurethane dispersions which have been prepared by chain lengthening of polyurethane prepolymers which contain active hydrogen which can react with polyisocyanates using polyisocyanates, such as are described e.g. in DE-A-39 03 804 and DE-A-40 01 841 may also be used.

Further examples of anionically stabilised polyurethane (PU) dispersions which can be used are those which are obtainable by chain lengthening of polyurethane resins which contain at least one CH acid group in the molecule with compounds which can react with at least two CH acid groups. Specific examples are the polyurethane resin dispersions described in DE-A-42 28 510.

PU dispersions based on polyurethane resins which have been chain lengthened via siloxane bridges may also be used. These are known, e.g. from DE-A-44 13 562.

Specific examples of anionically stabilised polyurethane based binders in which (meth)acrylic copolymer and polyurethane resin are covalently bonded or are present in the form of interpenetrating resin molecules, are described e.g. in EP-A-0 353 797, EP-A-0 297 576, DE-A-41 22 265, DE-A-41 22 266 and WO 95/16004.

The water-based base lacquers may contain a single water-based binder, but several water-based binders may also be combined. Water-based binders based on anionically stabilised polyurethanes are preferably used. Some, e.g. up to 50 wt. %, of the polyurethane binder may expediently be replaced by resins based on a combination of (meth)acrylic copolymer and polyester resin.

Furthermore, water-dilutable binders based on cellulose may be present.

To prepare the water-based base lacquers, in particular when the binders used are not self cross-linking, conventional cross-linking agents which are familiar to a person skilled in the art are used, such as for example formaldehyde condensation resins such as phenol/formaldehyde condensation resins and amine/formaldehyde condensation resins, and free or blocked polyisocyanates. The cross-linking agents may be used individually or in a mixture. The mixing ratio of cross-linking agent to binder resin is preferably 10:90 to 40:60, in particular 20:80 to 30:70, each with respect to the weight of solids.

The water-based base lacquers used in the process according to the invention contain, in addition to conventional physically drying and/or chemically cross-linking binders, pigments. The expression "pigments" used here includes inorganic and/or organic coloured pigments and/or effect pigments and optionally fillers. Any conventional pigments may be used. Examples are titanium dioxide, iron oxide pigments, carbon black, azo pigments, phthalocyanine pigments, metal pigments, e.g. consisting of titanium, aluminium or copper, interference pigments such as e.g. titanium dioxide coated aluminium, coated mica, graphite effect pigments, platelet iron oxide, platelet copper phthalocyanine pigments, talcum, barium sulfate, kaolin, silicon dioxide.

It is preferable that the pigment to volume concentration (p.v.c.) of the first and second base lacquer coating differ by not more than 30% of the absolute value of the pigment volume concentration in the second base lacquering agent. The pigment volume concentration in the first base lacquering agent is preferably less than that in the second base lacquering agent. The pigment volume concentration in a coating agent is the ratio of pigment volume to pigment volume plus binder volume and is calculated from the following equation:

$$p.v.c. = \frac{\text{volume of pigment}}{\text{volume of pigment} + \text{volume of binder}} \times 100\,\%$$

The same pigments are preferably used in both base lacquering agents, in particular the same pigmentation. Pigmentation is understood to be the relative composition of a pigment mixture, i.e. the type of pigments and the particular amounts thereof present in the pigment mixture. Pigmentations with similar average densities (these are obtained from the relative amounts of individual pigments present) are preferably also used in the two base lacquering agents. The average density of pigmentations in the two base lacquering agents preferably differs by not more than 20%, with respect to the average density of pigmentation in the second water-based base lacquer.

The colour-providing absorption pigments (coloured pigments) and optionally fillers are generally rubbed into some of the water-dilutable binder. The rubbing in process may also preferably take place in a specific water-dilutable paste resin. Paste resins suitable for water-based systems and familiar to a person skilled in the art may be used. A specific example of a preferably used paste resin based on an anionically stabilised polyurethane resin can be found in DE-A-40 00 889. The rubbing in process takes place in conventional equipment familiar to a person skilled in the art. The remaining portion of water-based binder or of water-based paste resin is then added to make up the final coloured pigment paste. If paste resins are present in the water-based base lacquer, then these are added to binders plus any optional cross-linking agent. The binder together with the cross-linking agent and paste resins produce the solid resin content of the water-based base lacquer.

Furthermore the water-based base lacquer may contain auxiliary agents which are conventionally used in lacquers, such as e.g. catalysts, flow control agents, antifoam agents, anti-cratering agents and in particular light stabilisers, optionally combined with antioxidants.

The water-based base lacquers have, for example, a solids content of 10 to 50 wt. %, for effect base lacquers it is preferably 15 to 30 wt. %, for uniformly coloured base lacquers it is preferably higher, for example 20 to 45 wt. %. The ratio of pigment to binder plus optional cross-linking agent plus optional paste resin in the water-based base lacquer is for example between 0.03:1 and 3:1, for effect base lacquers it is preferably 0.06:1 to 0.6:1, for uniformly coloured base lacquers it is preferably higher, for example 0.06:1 to 2.5:1, each with respect to the weight of solids. The first water-based base lacquer used to produce the second coating layer preferably has a lower pigment to binder ratio than the second water-based base lacquer used to produce the third coating layer. Here the expression binder includes the binder(s) as such plus optional cross-linking agent plus optional paste resins, wherein the sum of these constituents represents the solid resin content of the water-based base lacquer.

It is an essential component of the invention that the first water-based base lacquer used to produce the second coating layer is characterised by a higher percentage by weight of polyurethane resins as compared with the second water-based base lacquer used to produce the third coating layer. The absolute value of this excess of polyurethane resin in the first water-based base lacquer is preferably between 5 and 50%, in particular between 10 and 35% of the absolute value of the weight of solid resin in the second coating agent. Accordingly if the second base lacquering agent has a solid resin content of 20 wt. %, then the preferred absolute value for the polyurethane concentration in the first base lacquering agent is calculated as the sum of the polyurethane content X (wt. %) in the second coating agent plus 5 to 50 wt. % of 20 wt. %, i.e. the polyurethane content of the first coating agent is then preferably: X+(1 to 10) wt. %. Then, however, the absolute value of the weight of solid resin in the first base lacquering agent differs by not more than 20 wt. % from the absolute value of the weight of solid resin in the second base lacquering agent; thus in the previous example the resin content of the second base lacquering agent is 20 wt. %, so that the solid resin content of the first base lacquering agent is a total of 16 to 24 wt. %. The solid resin content of the first coating agent is preferably the same as or higher than that in the second base lacquering agent. For example the first base lacquering agent in accordance with a preferred procedure can be prepared from the second base lacquering agent by admixing an appropriate amount of polyurethane resin.

The higher proportion of polyurethane resin can, if polyurethane resin is contained in the second water-based base lacquer, be supplemented by the same polyurethane resin(s) or by different polyurethane resin(s). Examples of polyurethane resins which can make up the excess resin in the first base lacquer are the polyurethane resins described above as suitable for binders in water-based base lacquers.

In addition to the differentiating feature which is an essential component of the invention, the higher proportion of polyurethane resin in the first water-based base lacquer as compared with the second water-based base lacquer, water-based base lacquers which differ from each other in other features may be used for the second and third coating layers prepared by the process according to the invention, but similar water-based base lacquers are preferably used. In particular, the two water-based base lacquers differ exclusively by the previously mentioned differentiation feature which is an essential component of the invention, this is explained in more detail in the following.

It is particularly preferable that the first and second water-based base lacquer, apart from the excess polyurethane in the first water-based base lacquer, have qualitatively the same resin composition, i.e. the same binder and optional cross-linking agent and optional paste resins. In this case it is preferred that, by taking into account the specifications according to the invention, the quantities of each component in the solid resin composition, apart from the excess polyurethane, have a fluctuation range of less than 30%, preferably less than 20% and in particular less than 15%. In particular, it is preferred, that the two water-based base lacquers do not differ with regard to their qualitative or quantitative solid resin composition with the exception of the differentiation criterion which is an essential part of the invention. In addition it is preferred that the water-based base lacquer used to produce the second coating layer has a shade of colour which approximates to that in the water-based base lacquer used to produce the third coating layer or in particular is identical with this. In the context of the present invention, colour shades which approximate to each other is understood to mean that the difference in colour composed of the difference in brightness, difference in colour tone and difference in depth of colour between each of the covering lacquers and determined using a measuring geometry of (45/0), in the second and the third coating layers, does not exceed an n-fold $\Delta E^*$ (CIELAB) value. $\Delta E^*$ (CIELAB) reference values are those values which are produced on CIE-x,y diagrams (chromaticity diagrams), which are familiar to a person skilled in the art and are obtained in accordance with DIN 6175, for the colour shade of the third coating layer and wherein the following relationship applies:

$n \leqq 90$ in the region characterised by $\Delta E^*=0.3$ on the CIE-x,y diagram, $n \leqq 50$ in the region characterised by $\Delta E^*=0.5$ on the CIE-x,y diagram, $n \leqq 40$ in the region characterised by $\Delta E^*=0.7$ on the CIE-x,y diagram, $n \leqq 30$ in the region characterised by $\Delta E^*=0.9$ on the CIE-x,y diagram.

Basically any conventional clear lacquer or transparent, coloured or colourless pigmented coating agent is suitable as a clear lacquer coating agent for producing the fourth and optionally further coating layers. These may be single or multicomponent clear lacquer coating agents. They may be solvent-free (either liquid or clear lacquer powder), or they may be systems based on solvents or they may be water-dilutable clear lacquers in which the binding systems have been stabilised in a suitable manner, e.g. anionically, cationically or non-ionically. The water-dilutable clear lacquer systems may be systems which are soluble or dispersible in water, for example emulsion systems or powder slurry systems. The clear lacquer coating agents cure on stoving with the production of covalent bonds due to chemical cross-linking.

Clear lacquers which can be used in the process according to the invention are conventional clear lacquer coating agents which are familiar to a person skilled in the art and which contain one or more conventional base resins as film-forming binders. They may optionally also contain cross-linking agents if the base resin is not self cross-linking. The base resin component and also the cross-linking component are not subject to any restrictions at all. Polyester, polyurethane and/or (meth)acrylic copolymer resins, for example, may be used as the film-forming binders (base resins).

In addition to the chemically cross-linking binders and optional cross-linking agents, the clear lacquers which can be used in the process according to the invention may also contain additives conventionally used in lacquers such as e.g. catalysts, flow control agents, colorants, but in particular rheology regulators such as microgels, NAD (=non-aqueous dispersions), disubstituted ureas ("sagging control agents"), and light stabilisers optionally combined with antioxidants.

Specific examples of single (1C) and two component (2C) non-water-based clear lacquer systems which may be used in the process according to the invention as a clear lacquer may be found in DE-A-38 26 693, DE-A-40 17 075, DE-A-41 24 167, DE-A-41 33 704, DE-A-42 04 518, DE-A-42 04 611, EP-A-0 257 513, EP-A-0 408 858, EP-A-0 523 267, EP-A-0 557 822, WO-92 11 327.

Specific examples of single (1C) or two component (2C) water-based clear lacquer systems which can be used as a clear lacquer in the process according to the invention may be found in DE-A-39 10 829, DE-A-40 09 931, DE-A-40 09 932, DE-A-41 01 696, DE-A-41 32 430, DE-A-41 34 290, DE-A-42 03 510, EP-A-0 365 098, EP-A-0 365 775, EP-A-0 496 079, EP-A-0 546 640.

Specific examples of powdered clear lacquer systems which can be used as the clear lacquer according to the invention may be found in EP-A-0 509 392, EP-A-0 509 393, EP-A-0 522 648, EP-A-0 544 206, EP-A-0 555 705, DE-A-42 22 194, DE-A-42 27 580.

The transparent coating may be applied in a single layer or in the form of several layers consisting of the same or of several different transparent coating agents. However, the transparent surface coating layer is expediently applied as a fourth layer consisting of only one clear lacquer coating agent.

Electrically conductive materials such as, for example, metals are suitable as a substrate for the process according to the invention. Automobile car bodies or parts thereof are particularly suitable. They may consist of pretreated or non-pretreated metal, metal provided with an electrically conductive layer or plastic which is electrically conductive or provided with an electrically conductive layer. The first surface coating layer, in particular in the form of an anti-corrosion primer, is electrodeposited on this substrate in a conventional manner and with a dry layer thickness of, for example, 15 to 35 $\mu$m which is conventional for EDL primers and stoved. In the special case of pre-coated substrates, multi-coat lacquerings are obtained with more than the four coating layers produced according to the invention, but within the context of the present invention the first electrodeposition lacquer layer applied in the process according to the invention is called the first coating layer.

The second coating layer consisting of the first colouring and/or effect-producing water-based base lacquer is preferably applied to the substrate provided with the stoved EDL layer in a spray process with a dry layer thickness of 10 to less than 30 μm, for example 10 to 29 μm, preferably 10 to 25 μm, in particular 10 to 20 μm, depending on the covering power of the colour shade. Examples of suitable spray application processes are compressed air spraying, airless spraying or electrostatic (ESTA) high speed rotary spraying, wherein electrostatic spraying is the preferred method of application for applying the first water-based base lacquer. After a brief evaporation time, optionally at an elevated temperature of up to 80° C., but preferably at ambient temperature, the third coating layer consisting of the second colouring and/or effect-producing water-based base lacquer is applied in a spray process, preferably using compressed air spraying, preferably with a thinner dry layer thickness than the second coating layer, of only 7 to 15 μm, and evaporated for a short time, optionally at temperatures up to 80° C., for example for 1 to 5 minutes, e.g. under the effect of infra-red radiation. Following application and evaporation of the third coating layer, the clear lacquer is applied in a wet-on-wet process.

The fourth coating layer is over-lacquered with a dry layer thickness of for example 30 to 80 μm, preferably 30 to 60 μm, as is conventional for a clear lacquer layer, using a conventional liquid clear lacquer or powder clear lacquer (in this it is a matter of a dry-on-wet application) and stoved together with the second and third coating layer. The stoving temperature during mutual stoving of the three coating layer is, for example, between 80 and 160° C., preferably less than 140° C.

Further clear lacquer layers consisting of the same or different clear lacquer coating agents may optionally be applied before or after stoving.

The process according to the invention enables the production of four-layered or multilayered lacquerings, in particular vehicle lacquerings with a reduced total thickness and comparable overall characteristics when compared with those produced in the prior art which include filler layers and/or other intermediate layers. Only two stoving steps are required. It has been shown that outstanding characteristics are produced by the procedure according to the invention although this facilitates omitting conventional filler layers.

EXAMPLE 1

(Prior art, lacquering with a filler layer)

A water-based base lacquer (blue metallic) is applied with a dry layer thickness of 15 μm by spraying onto a conventionally phosphated car body panel which has been pre-coated with a 30 μm thick filler layer by cathodic electrodeposition. After application the coating is allowed to evaporate for a short while and then pre-dried for 10 min at 80° C. Then the panel is over-lacquered with a commercial production line 2C-HS car clear lacquer (two component, high solid, clear lacquer based on acrylic resin/polyisocyanate) with a dry layer thickness of 40 μm and dried for 30 min at 130° C. (object temperature). The water-based base lacquer (blue metallic) consists of the following components:

| | |
|---|---|
| 17.00 | parts of water-based polymer dispersion from DE-A-36 28 124, production example 1 |
| 9.20 | parts of water-based polyurethane dispersion from DE-A-42 24 617, production example 2 |
| 3.10 | parts of water-based polyurethane resin in accordance with the example from DE-A-40 00 889 |
| 2.70 | parts of hexamethoxy methylmelamine |
| 1.00 | parts of aluminium bronze |
| 1.60 | parts of Cu phthalocyanine pigment |
| 0.90 | parts of talcum |
| 0.50 | parts of conventional lacquer defoamer |
| 0.50 | parts of conventional lacquer wetting agent |
| 7.00 | parts of butoxyethanol |
| 2.50 | parts of 2-propanol |
| 2.50 | parts of 2-butanol |
| 51.50 | parts of deionised water |

The solid resin content (absolute value of the weight of solid resin) in this water-based base lacquer is 13.8 wt. %.

EXAMPLE 2

(comparison, lacquering without a filler layer)

The water-based base lacquer (blue metallic) from example 1 is applied with a dry layer thickness of 15 μm by spraying onto a conventionally phosphated car body panel which has been pre-coated by cathodic electrodeposition. After application the lacquer is allowed to evaporate for a short while and then a second layer of the same water-based base lacquer is applied with a dry layer thickness of 10 μm, also by spraying. This is pre-dried for 10 min at 80° C. Then it is over-lacquered with production line 2C-HS car clear lacquer from example 1 with a dry layer thickness of 40 μm and dried for 30 min at 130° C. (object temperature).

EXAMPLE 3a–c (according to the invention)

Example 2 is repeated with the difference that the 15 μm thick lacquer layer applied to the CDL layer did not consist of the water-based base lacquer (blue metallic) from example 1 but of a modified water-based base lacquer (blue metallic), whereas the lacquer layer subsequently applied with a 10 μm dry layer thickness is produced from the water-based base lacquer (blue metallic) from example 1 in the same way as in example 2. The modified water-based base lacquer (blue metallic) is produced by mixing 87 parts of the water base lacquer (blue metallic) from example 1 with 13 parts of a water-based polyurethane resin adjusted to a solids content of 34 wt. %. The water-based polyurethane resins used are:

a) water-based polyurethane dispersion from DE-A-42 24 617, production example 2
b) water-based polyurethane resin in accordance with the example in DE-A-40 00 889
c) water-based polyurethane dispersion from WO 95/28 249, production example 1

The solid resin content (absolute value of the weight of solid resin) of water-based base lacquers 3a), 3b) and 3c) were each 16.4 wt. %. Thus there was an excess of (16.4−13.8)×100/13.8=18.9 wt. % of solid resin, and thus also of polyurethane resin, in comparison with water-based base lacquer from example 1.

EXAMPLE 4

(prior art, lacquering with a filler layer)

The water-based base lacquer (black) described below is applied with a dry layer thickness of 20 μm, by spraying, onto a conventionally phosphated car body panel pre-coated by cathodic elecrodeposition and precoated with a 30 μm thick filler layer. After application the coating is allowed to evaporate for a brief time and pre-dried for 10 min at 80° C.

This is then over-lacquered with the production line 2C-HS car clear lacquer from example 1 with a dry layer thickness of 40 μm and dried for 30 min at 130° C. (object temperature). The water-based base lacquer (black) consisted of the following components:

| | |
|---|---|
| 11.00 | parts of 60 wt. % strength binder from WO 95/16004, point 2, example 4 |
| 19.90 | parts of water-based polyurethane dispersion from DE-A-42 24 617, production example 2 |
| 12.90 | parts of water-based polyurethane resin in accordance with the example from DE-A-40 00 889 |
| 3.80 | parts of hexamethoxy methylmelamine |
| 3.00 | parts of carbon black |
| 2.00 | parts of talcum |
| 0.70 | parts of conventional lacquer defoamer |
| 1.20 | parts of conventional lacquer wetting agent |
| 0.70 | parts of adhesion promoter |
| 5.70 | parts of butoxyethanol |
| 4.50 | parts of diethyleneglycol monobutylether |
| 3.00 | parts of N-methylpyrrolidone |
| 0.30 | parts of dimethylethanolamine |
| 31.30 | parts of deionised water |

This water-based base lacquer had a solid resin content of 21.9 wt. %.

EXAMPLE 5

(comparison, lacquering without a filler layer)

The water-based base lacquer (black) from example 4 is applied with a dry layer thickness of 15 μm by spraying onto a conventionally phosphated car body panel which has been pre-coated by cathodic electrodeposition. After application the lacquer is allowed to evaporate for a short while and then a second layer consisting of the same water-based base lacquer is applied with a dry layer thickness of 10 μm, by spraying. This is pre-dried for 10 min at 80° C. This coating is then over-lacquered with the production line 2C-HS car clear lacquer from example 1 with a dry layer thickness of 40 μm and dried for 30 min at 130° C. (object temperature).

EXAMPLE 6a–c (according to the invention)

Example 5 is repeated with the difference that the 15 μm thick lacquer layer applied to the CDL layer does not consist of the water-based base lacquer (black) from example 4 but of a modified water-based base lacquer (black), while the lacquer layer applied in a 10 μm dry layer thickness is produced from the water-based base lacquer (black) from example 4, in the same way as in example 5. The modified water-based base lacquer (black) is prepared by mixing 85 parts of the water-based base lacquer (black) from example 4 with 15 parts of a polyurethane resin adjusted to a solids content of 34 wt. %. The following were used as water-based polyurethane resins:

a) water-based polyurethane dispersion from DE-A-42 24 617, production example 2
b) water-based polyurethane resin in accordance with the example from DE-A-40 00 889,
c) water-based polyurethane dispersion from WO 95/28 249, production example 1.

The water-based base lacquers 6a), 6b) and 6c) each has a solids resin content of 23.7 wt. %. The excess of solid resin, and in the present cases also of polyurethane resin, as compared with the water-based base lacquer from example 4 is therefore (23.7–21.9)×100/21.9=8.3 wt. %.

The multi-coat lacquerings from examples 1, 2, 3a–c and also from examples 4, 5, 6a–c do not differ with regard to their adhesion or their resistance to condensed water, the results correspond to conventional modern technological requirements.

Table 1 gives the results of stone impact tests.

TABLE 1

| | Multilayered lacquering | | | | | | | | | |
|---|---|---|---|---|---|---|---|---|---|---|
| EXAMPLE | 1 | 2 | 3a | 3b | 3c | 4 | 5 | 6a | 6b | 6c |
| VDA stone impact test [1] | 1 | 3 | 1 | 1 | ./. | 1 | 3 | 1 | 1 | ./. |
| Stone impact by "chippings" method [2] | 7 0–1 | 12 4–5 | 3 0–1 | 5 0–1 | 6 1 | 5 0–1 | 10 4–5 | 4 0–1 | 4 0–1 | 4 1 |

[1] Test using stone impact test equipment in accordance with VDA (Erichsen Co, model 508) at + 20° C. with 2 portions of 500 g of steel scrap (angular 4–5 mm), accelerated by compressed air at 1 bar.
Assessment: value 0 = best value, value 10 = poorest value.
[2] Test using stone impact simulation equipment in accordance with "Farbe und Lack", 8/1984, pp 646–653, test temperature: −20° C., test material: sphere with a weight of 0.15 g and a diameter of 2 mm, impact angle: 5°, impact speed: 250 km/h.
./. = not determined.
Assessment: data gives the circular damaged area in $mm^2$ and the degree of rust determined at the damaged area following 10 minutes' exposure to 1% strength copper sulfate solution, degree of rust 0 = best value, degree of rust 5 = poorest value.

What is claimed is:

1. A process for producing a multi-coat lacquering on a substrate provided with a stoved first electrodeposition lacquer layer, comprising:

applying a second coating layer corresponding to a dry layer thickness of 10 μm to less than 30 μm comprising a first water-based, colour-providing and/or effect-providing base lacquering agent which contains one or more polyurethane resins to the first electrodeposition lacquer layer;

applying wet-on-wet, a third coating layer corresponding to a dry layer thickness of 7 μm to 15 μm, comprising a second water-based, colour-providing and/or effect-providing base lacquering agent;

applying a fourth coating layer comprising a clear lacquer coating agent to the third coating layer without prior stoving; and stoving the second, third and fourth coating layers together wherein the first and second water-based base lacquering agents contain the same or different polyurethane resins;

wherein the first base lacquering agent has a higher concentration of polyurethane resin than the second base lacquering agent, with respect to total weight of the respective water-based base lacquering agent; and wherein solid resin content in the first base lacquering agent differs by not more than 20% from an absolute value of weight of solid resin in the second base lacquering agent.

2. A process according to claim 1, wherein the first water-based base lacquering agent is produced by admixing polyurethane resin to the second base lacquering agent.

3. A process according to claim 1, wherein excess of polyurethane resin in the first water-based base lacquering agent is 5 to 50% of the absolute value of the weight of solid resin in the second base lacquering agent.

4. A process according to claim 1, wherein the first base lacquering agent has a pigment volume concentration which differs by not more than 30% from an absolute value of pigment volume concentration in the second base lacquering agent.

5. A process according to claim 1, wherein apart from excess polyurethane resin content of the first base lacquering agent, resins which form the solid resin content of the first and second base lacquering agents have the same qualitative and quantitative composition.

6. A process according to claim 1, wherein the same pigmentation is present in both the first and second base lacquering agents.

7. A process according to claim 1, wherein pigment content, with respect to solids content, is higher in the second base lacquering agent than in the first base lacquering agent.

8. A process according to claim 1, comprising lacquering vehicles or parts of vehicles.

9. A process according to claim 1, wherein pigmentations in the first and second base lacquering agents have similar average densities.

* * * * *